US005591376A

United States Patent [19]

Kiewert et al.

[11] Patent Number: 5,591,376

[45] Date of Patent: Jan. 7, 1997

[54] CLEANING COMPOSITIONS FOR HARD SURFACES

[75] Inventors: Eva Kiewert, Duesseldorf; Peter Jeschke, Neuss; Birgit Middelhauve, Monheim, all of Germany; Giuseppe Carrer, Milan, Italy

[73] Assignee: Henkel Kommanditgesellschaft auf Aktien, Duesseldorf, Germany

[21] Appl. No.: 325,323

[22] PCT Filed: Apr. 8, 1993

[86] PCT No.: PCT/EP93/00875

§ 371 Date: Nov. 29, 1994

§ 102(e) Date: Nov. 29, 1994

[87] PCT Pub. No.: WO93/20179

PCT Pub. Date: Oct. 14, 1993

[30] Foreign Application Priority Data

Mar. 30, 1992 [DE] Germany ..... 42 10 365.7

[51] Int. Cl.[6] ..... C11D 1/12; C11D 1/755; B08B 9/00; B08B 3/14

[52] U.S. Cl. ..... 510/437; 134/22.14; 134/42; 510/238; 510/194; 510/189; 510/185

[58] Field of Search ..... 252/174.17, 174.18, 252/DIG. 1, DIG. 16, DIG. 14, 549, 550, 554; 134/42, 22.14

[56] References Cited

U.S. PATENT DOCUMENTS

| | | | |
|---|---|---|---|
| H468 | 5/1988 | Malik et al. | 252/542 |
| 3,981,826 | 9/1976 | Munro | 252/526 |
| 4,065,409 | 12/1977 | Flanagan | 252/528 |
| 4,079,078 | 3/1978 | Collins | 252/545 |
| 4,147,652 | 4/1979 | Kaniecki | 252/174.17 |
| 4,483,780 | 11/1984 | Llenado | 252/174.17 |
| 4,606,850 | 8/1986 | Malik | 252/528 |
| 4,627,931 | 12/1986 | Malik | 252/174.17 |
| 5,223,179 | 6/1993 | Connor et al. | 252/548 |
| 5,290,472 | 3/1994 | Michael | 252/170 |
| 5,342,534 | 8/1994 | Skrobala et al. | 252/91 |
| 5,356,479 | 10/1994 | Menke et al. | 134/2 |
| 5,366,654 | 11/1994 | Van DenBrom et al. | 252/174.17 |

FOREIGN PATENT DOCUMENTS

| | | | |
|---|---|---|---|
| 0070076 | 7/1982 | European Pat. Off. | C11D 1/86 |
| 0070075 | 1/1983 | European Pat. Off. | C11D 1/83 |
| 0070077 | 1/1983 | European Pat. Off. | C11D 1/83 |
| 0075995 | 4/1983 | European Pat. Off. | C11D 3/22 |
| 0070074 | 6/1983 | European Pat. Off. | C11D 1/83 |
| 0136844 | 4/1985 | European Pat. Off. | C11D 3/22 |
| 0199765 | 11/1986 | European Pat. Off. | C11D 17/00 |
| 0202638 | 11/1986 | European Pat. Off. | C11D 1/825 |
| 0474915 | 3/1992 | European Pat. Off. | C11D 10/04 |
| 8809369 | 12/1988 | WIPO | C11D 17/00 |
| 9103538 | 3/1991 | WIPO | C11D 1/825 |
| 9114760 | 10/1991 | WIPO | C11D 1/825 |

OTHER PUBLICATIONS

"Seifen–Öle–Fette–Wachse", 112, 371, 1986 (month not available).

*Primary Examiner*—Glenn A. Caldarola
*Assistant Examiner*—Patricia L. Hailey
*Attorney, Agent, or Firm*—Ernest G. Szoke; Wayne C. Jaeschke; Real J. Grandmaison

[57] ABSTRACT

A process for cleaning hard surfaces comprising contacting the hard surfaces with a composition containing:

(a) from 0.1 to 50% by weight, based on the weight of the composition, of an alkyl polyglucoside having the general formula R O $Z_x$ wherein R is $C_{8-10}$, O is oxygen, x is an integer from 1 to 6, and Z is a sugar unit;

(b) from 0.001 to 30% by weight, based on the weight of the composition, of a $C_{6-16}$ fatty alcohol alkoxylate having an HLB value greater than 10;

(c) from 0.001 to 15% by weight, based on the weight of the composition, of a $C_{8-22}$ fatty acid; and (d) the balance up to 100% water.

5 Claims, No Drawings

CLEANING COMPOSITIONS FOR HARD SURFACES

FIELD OF THE INVENTION

This invention relates to low-foaming cleaning compositions for hard surfaces. In the context of the invention, hard surfaces are understood to be any non-textile surfaces encountered in the domestic and institutional sector, except for crockery. The expression "multipurpose cleaners" (hereinafter referred to as MPC's) has been adopted for cleaning compositions of this type. Low-foaming MPC's are those which, after manual application, produce a minimal foam volume which is significantly further reduced within a few minutes.

MPC's have been known for some time. They are essentially aqueous surfactant solutions of various kinds with or without additions of builders and with and without additions of water-soluble salts or solubilizers. The high cleaning power of MPC's has been increasingly found to be a disadvantage in practice in cases where they are manually applied. Although the consumer wants to see some foaming of the in-use solution at the beginning of cleaning as proof of its effectiveness, the foam should then disappear as quickly as possible so that surfaces which have been cleaned do not have to be rewiped.

To meet this increasing need for lower foaming power, some manufacturers of MPC's have opted to reduce the surfactant content of their market products to a significant extent, although this does of course lead to a considerable loss of cleaning power. The user of such products has to compensate for this loss of cleaning power by intensified mechanical wiping.

DISCUSSION OF RELATED ART

By virtue of their ecologically favorable properties, the use of alkyl polyglucosides (hereinafter referred to as APG's) in detergents and cleaning composition is enjoying increasing popularity. However, alkyl polyglucosides are known to be high-foaming surfactants, being recommended in particular for products where high foaming power is required, i.e. for example for manual dishwashing detergents and for hair shampoos. EP 70 074, 70 075, 70 076 and 70 077 (Procter & Gamble) describe high-foaming detergents based on various APG-containing surfactant combinations. Accordingly, these combinations are not recommended for multipurpose cleaners.

Special short-chain $C_{8-10}$ alkyl glucosides (for example Trition® CG-110, a product of Rhöm and Haas) have also long been known as high-foaming nonionic surfactants which generate stable foams. Low-foaming detergents-containing alkyl polyglucosides for use in machine washing, particularly machine dishwashing, are described in WO 88/09369 (Staley). The low-foaming character of these detergents is attributable to the presence of conventional low-foaming fatty alcohol alkoxylates which have an HLB value of around 10 or less and which may contain propylene oxide units.

The problem addressed by the present invention was to provide compositions for use in the manual cleaning of hard surfaces, excluding crockery, which would combine high cleaning power and high biological degradability with very low foaming power. The criterion for this would be a visible reduction in foam initially formed within 5 minutes.

DESCRIPTION OF THE INVENTION

It has now surprisingly been found that multipurpose cleaners combining high cleaning power with extremely weak foaming behavior can be obtained by means of combinations of certain short-chain alkyl polyglucosides known for their high foaming power with certain nonionic surfactants and fatty acids.

Accordingly, the problem addressed by the invention is solved by compositions essentially containing the following ingredients (all percentages are by weight, based on active substance):

a) 0.1 to 50 and preferably 0.1 to 45% of alkyl polyglucosides corresponding to the formula R O $Z_x$ where R=$C_{8-10}$, O=oxygen and x=1 to 6, Z being a sugar unit, for example a glucose or xylose unit, b) 0.001 to 30 and preferably 0.005 to 20% of a $C_{6-16}$ and preferably $C_{8-10}$ fatty alcohol alkoxylate with an HLB value above 10 and preferably $\geqq 11$, c) 0.001 to 15 and preferably 0.001 to 10% of $C_{8-22}$ and preferably $C_{10-18}$ fatty acids and d) balance to 100% water and auxiliaries typically encountered in MPC's.

In one preferred embodiment of the invention, MPC's of the type mentioned above additionally contain typical anionic surfactants, such as fatty alcohol sulfates, fatty alcohol ether sulfates, olefin sulfonates, paraffin sulfonates or mixtures thereof in quantities of less than 25% and preferably in quantities of less than 20% of the total quantity of surfactants according to a)+b)+c) in order not to impair the foaming behavior of the cleaning composition.

The APG's used in the MPC's according to the invention are fatty alcohol polyglycosides with the composition R O (Z) where R is an alkyl radical containing 8 to 10 carbon atoms, Z is a sugar unit, for example a glucose or xylose unit, and x=1–6 and preferably 1–3. By "alkyl radical" is meant the alkyl chain of fatty alcohols of natural or synthetic origin.

The fatty alcohol alkoxylates to be used in accordance with the invention are those with an HLB value of greater than 10 and preferably with an HLB value of or greater than 11. These compounds show even better biodegradability than those with HLB values of less than 10, as described in WO 88/09369 (Staley). According to Griffin, the HLB value is defined as follows:

$$HLB = \frac{\text{Molecular weight of the hydrophilic component}}{\text{Molecular weight of the fatty alcohol alkoxylate}} \cdot 20$$

Adducts of around 3 to 20 and preferably 4 to 10 moles of ethylene oxide (EO) with 1 mole of fatty alcohol containing 6 to 16 and preferably 8 to 10 carbon atoms in the alkyl chain are particularly preferred. The fatty alcohols used as starting materials may be prepared both from natural oils and fats and also synthetically.

The fatty acids to be used in accordance with the invention are carboxylic acids containing 8 to 22 and preferably 10 to 18 carbon atoms in the alkyl chain. Depending on the pH value of the compositions according to the invention, they are present either in free form or in partly or completely neutralized form, i.e. in salt form. Suitable cations of these salts are alkali metal cations or nitrogen-containing cations, such as ammonium or alkanolammonium ions.

The auxiliaries optionally used are substances of the type typically encountered in MPC's as builders, solvents, hydrotropes, cleaning boosters, viscosity regulators, pH regulators, preservatives, dyes and fragrances, opacifiers, etc.

In cases where known anionic surfactants are also used for additional effects, for example to increase viscosity or to improve the wetting of difficult surfaces, it is important to test them for any effects on the foaming behavior of the final formulation. The quantities in which they are used should at all events make up less than 25% and preferably less than 20% of the total quantity of MPC's, special FA alkyl alkoxylates and fatty acids. $C_{2-6}$ alkyl glucosides containing 1 to 10 glucose units, which are known for example from EP 136 844 (Staley), may also be used as viscosity regulators.

The MPC's according to the invention do not of course contain any foam-promoting surfactants, such as amine oxides or fatty acid alkanolamides.

Cleaning compositions containing 1 to 90% by weight of $C_{8-18}$ alkyl polyglucosides with 1.5 to 10 glucose units in the molecule, 1 to 90% by weight of $C_{8-22}$ fatty alcohol ethoxylates with 2 to 12 moles of ethylene oxide and HLB values of 6 to 15, 1 to 15% by weight of $C_{8-24}$ fatty acids and optionally other synthetic anionic surfactants are known from EP 75 995 (Procter & Gamble). However, they are exclusively used for cleaning textiles and are not discussed in regard to their foaming behavior.

EP 199 765 (Henkel KGaA) describes $C_{10-24}$ alkyl monoglucosides as viscosity regulators inter alia for soap solutions which may only contain small quantities of nonionic surfactants because otherwise their viscosity would be adversely affected.

Liquid cleaning compositions containing 2 to 60% by weight of $C_{8-18}$ alkyl monoglucosides, 0.1 to 10% by weight of nonionic surfactants with an HLB value of less than 5 and 0.1 to 10% by weight nonionic surfactants with an HLB value of not less than 5 and also 0.001 to 8% by weight of one or more intentional organic or inorganic salts are known from EP 408 965 (Kao). These known liquid cleaners are high-foaming. The novel use of the special cleaning compositions according to the invention was not logical from the prior art.

Tests

To demonstrate their advantages over known cleaning compositions for hard surfaces, the cleaning compositions according to the invention were compared with known cleaning compositions in regard to cleaning power.

Cleaning power was tested by the method according to "Seifen-öle-Fette-Wachse" 112, 371 (1986) which is described below and which provides highly reproducible results. In this test, the cleaning composition to be tested is applied to an artificially soiled plastic surface. A mixture of soot, engine oil, a triglyceride of saturated fatty acids and a low-boiling aliphatic hydrocarbon was used as the artificial soil for dilute application. The 26×28 cm test surface was uniformly coated with 2 g of the artificial soil using a surface spreader.

A plastic sponge was soaked with 10 ml of the cleaning solution to be tested and moved mechanically over the test surface which had also been coated with 10 ml of the cleaning solution to be tested. After 10 wiping movements, the cleaned test surface was held under running water and the loose soil was removed. The cleaning effect, i.e. the whiteness of the plastic surface thus cleaned, was measured with a color difference measuring instrument (Dr. B. Lange "Microcolor"). The clean white plastic surface was used as the white standard.

Since the instrument was adjusted to 100% in the measurement of the clean surface and the soiled surface produced a reading of 0, the values read off could be equated with the percentage cleaning power (% CP) for the cleaned plastic surfaces. In the following tests, the % CP values shown are the values determined by this method for the cleaning power of the cleaning compositions tested. They each represent the average values of 3 determinations.

The measurements were correlated with the cleaning result of a commercial low-foaming MPC used as standard.

$$\frac{\text{Measured value of sample} \cdot 100}{\text{Measured value of standard}} = \%\ CP \text{ relative}$$

The MPC used as standard, which was commercially available on the filing date of the present application, had the following composition:

2.0% alkanesulfonate 1.5% fatty alcohol ethoxylate 0.5% soap 4.0% butyl diglycol ad 100.0% water, dyes and fragrances, preservative.

The foaming behavior of the MPC's according to the invention was tested as follows:

The product to be tested was introduced into a wide-mouth glass beaker. Tap water is then run in from a height of 30 cm in the quantity which, together with the quantity of product initially introduced, forms the recommended in-use solution of the product. The foam height in the glass beaker is read off immediately after and 3 minutes after introduction of the water. The foam height after 3 minutes is correlated with the initial foam and the foam collapse is calculated as follows:

$$\text{Foam collapse (\%)} = \frac{\text{Initial foam height} - \text{foam height after 3 minutes}}{\text{Initial foam height}} \cdot 100$$

A typical low-foaming MPC has a foam collapse of more than 50%.

EXAMPLE 8

The following Examples were prepared by mixing the components together and then adjusting the required pH value. All percentages are based on % by weight of active substance.

EXAMPLE 1

5.0% by weight $C_{8-10}$ APG 2.0% by weight $C_{8-10}$ fatty alcohol•4EO 0.5% by weight coconut oil fatty acid 2.0% by weight citric acid X % by weight sodium hydroxide to adjust the pH value of the end product to pH 7.5 ad 100.0% by weight water, dyes and fragrances, preservative

Example 1 represents an MPC which is used in the form of a 1% solution. In this concentration, the foam collapse is 100%, the relative cleaning power by comparison with the standard similarly tested in the form of a 1% solution is 150%.

Despite being so low-foaming, the MPC according to the invention develops far more cleaning power than the commercial comparison product.

EXAMPLE 2

45.0% by weight $C_{8-10}$ APG 20.0% by weight $C_{8-10}$ fatty alcohol•4EO 5.0% by weight palm kernel oil fatty acid 1.0% by weight citric acid 10.0% by weight cumene sulfonate X % by weight potassium hydroxide to adjust the pH value of the end product to pH 8 ad 100.0% by weight water, dyes and fragrances.

Example 2 represents a high MPC concentrate which is used in the form of a 0.1% solution. In this concentration, the MPC has a foam collapse of 100%, a cleaning power of 170% by comparison with the standard used in the form of a 1% solution.

EXAMPLE 3

2.0% by weight $C_{8-10}$ alkyl polyglucoside 0.5% by weight $C_4$ APG 1.0% by weight $C_{12-14}$ fatty alcohol•1 PO•5 EO 1.0% by weight palm kernel oil fatty acid 2.0% by weight dicarboxylic acid mixture (glutaric acid, adipic acid and succinic acid)

0.05% by weight polyethylene oxide, MW 600,000

2.0% by weight butyl glycol

X % by weight sodium hydroxide for adjustment to pH 8 ad 100.0% by weight water, dyes and fragrances, preservative.

Used in the form of a 1% solution, Example 3 shows a foam collapse of 100%, a relative cleaning power of 130% by comparison with the standard also tested in the form of a 1% solution.

EXAMPLE 4

0.5% of fatty alcohol ether sulfate was added to Example 3 in order intentionally to stop the foam collapse from falling to 100%. The content of additional surfactant did not affect the cleaning power of the composition. The foam collapse was 90%.

EXAMPLE 5

0.1% by weight $C_{8-10}$ alkyl polyglucoside 0.05% by weight $C_{12-14}$ fatty alcohol•6 EO 0.001% by weight coconut oil fatty acid 7.0% by weight ethanol X % by weight ammonia for adjustment to pH 10 ad 100.0 % by weight water.

Example 5 represents a multipurpose spray cleaner applied in undiluted form with a hand spray pump. In this form, the foam collapse is determined by visual monitoring of the spray process: the sprayed surface to be cleaned did not show any foam bubbles immediately after application of the spray cleaner. The relative cleaning power was 180% by comparison with the 1% in-use solution of the standard.

EXAMPLE 6

12.5% by weight $C_8$ alkyl xyloside containing approximately 1.2 xylose units 12.5% by weight $C_{10}$ alkyl xyloside containing approximately 1.5 xylose units 11.1% by weight $C_8$ fatty alcohol•4 EO 2.8% by weight coconut oil fatty acid 2.4% by weight citric acid 5.6% by weight cumenesulfonate X % by weight potassium hydroxide to adjust the pH value of the end product to pH 7.5 ad 100 % by weight water, dyes and fragrances.

A 1% solution showed a foam collapse of 80% and a relative cleaning power of 126% by comparison with the standard.

We claim:

1. A process for cleaning hard surfaces comprising contacting said hard surfaces with a low-foaming cleaning composition consisting of (a) from 0.1 to 50% by weight, based on the weight of said composition, of an alkyl polyglucoside having the general formula R O $Z_x$ wherein R is $C_{8-10}$, O is oxygen, x is an integer from 1 to 6, and Z is a sugar unit;

(b) from 0.001 to 30% by weight, based on the weight of said composition, of a $C_{6\ 16}$ fatty alcohol alkoxylate having an HLB value greater than 10;

(c) from 0.001 to 15% by weight, based on the weight of said composition, of a $C_{8-22}$ fatty acid; and (d) the balance, water.

2. The process of claim 1 wherein said alkyl polyglucoside is present in an amount of from 0.1 to 45% by weight, based on the weight of said composition.

3. The process of claim 1 wherein x is an integer of from 1 to 3.

4. The process of claim 1 wherein said HLB value is at least 11.

5. The process of claim 3 wherein said fatty acid is present in an amount of from 0.001 to 10% by weight, based on the weight of said composition.

* * * * *